US006401974B1

(12) United States Patent
Elkind

(10) Patent No.: US 6,401,974 B1
(45) Date of Patent: Jun. 11, 2002

(54) VERSATILE SYSTEM FOR FOUNTAIN BEVERAGE MIXING

(75) Inventor: Jerome L. Elkind, Richardson, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/717,997

(22) Filed: Nov. 20, 2000

(51) Int. Cl.[7] ..... B67D 5/56; B67D 5/60; B67D 5/62

(52) U.S. Cl. ..... 222/1; 222/129.4; 222/145.6; 222/145.8

(58) Field of Search ..... 222/145.1, 145.5, 222/145.6, 145.8, 1, 129.1–129.4

(56) References Cited

U.S. PATENT DOCUMENTS 3,884,388 A * 5/1975 Holcomb ..... 222/145.1
4,008,832 A * 2/1977 Rodth ..... 222/129.1
4,750,645 A * 6/1988 Wilson et al. ..... 222/145.1
5,570,822 A * 11/1996 LeMarbe et al. ..... 222/459

* cited by examiner

*Primary Examiner*—Henry C. Yuen
*Assistant Examiner*—Stephanie Willatt
(74) *Attorney, Agent, or Firm*—William B. Kempler; Frederick J. Telecky, Jr.; W. James Brady

(57) ABSTRACT

A versatile system (300) for fountain beverage dispensing is disclosed, including a plurality of beverage supply sources (302, 304) adapted to supply a plurality of beverage constituents; a beverage mixing apparatus (200) having a first aperture (206) adapted to receive the plurality of beverage constituents, a second aperture (208) adapted to dispense a mixture of the beverage constituents, and a conduit (202) interposed between the first and second apertures and adapted (210) to mix the plurality of beverage constituents; a dispensing nozzle (320) engaged with the second aperture; and a sensor device (322) disposed along the conduit, proximal to the second aperture, and adapted to adjust the supply of a beverage constituent.

19 Claims, 3 Drawing Sheets

VERSATILE SYSTEM FOR FOUNTAIN BEVERAGE MIXING

FIELD OF THE INVENTION

This invention relates in general to beverage dispensing systems and, more particularly, to a versatile system for mixing beverages dispensed from a fountain or similar dispensing apparatus.

BACKGROUND OF THE INVENTION

The dispensing of fountain beverages (e.g., sodas and juices) is generally accomplished using either premix systems—in which a finished beverage is delivered to a proprietor from a bottler—or postmix systems—in which flavored or base syrup is delivered to the proprietor and mixed with water at the point of delivery.

A premix system generally utilizes product containers filled with a finished beverage which may be under carbon dioxide pressure. In these systems, the product is normally delivered to the consumer via a single orifice dispensing valve. Premix systems are also used in bottling plants, which typically operate at extremely high flow rates. These systems are relatively expensive installations, and the costs associated with shipping a finished product (e.g., syrup and water) are much greater than those associated with shipping postmix materials (e.g., syrup only). Thus, premix systems are generally unsuitable for most typical food service settings. Postmix systems are much more cost effective than premix systems, and are generally predominant in food service and consumer use applications.

A postmix system generally utilizes a base syrup in combination with carbonated or still water at a prescribed ratio, delivered through a dispensing nozzle at a fountain having passages for both the syrup and water. In most conventional systems, the nozzle either combines the syrup and water immediately before delivery into a cup, or concurrently dispenses independent streams of syrup and water into the cup, allowing mixing to occur inside the cup.

FIG. 1 provides an illustrative, exploded-view diagram of portions of a conventional beverage dispenser system 100. System 100 typically comprises a valve or solenoid member 102 for syrup delivery, a valve or solenoid member 104 for water delivery, a control assembly 105 communicatively coupled to members 102 and 104, and conduits 106 and 108 coupled to members 102 and 104, respectively, for providing syrup and water to the valve members from external sources (e.g., tanks or water lines). Responsive to a consumer depressing the dispensing actuator 110, syrup and water are conducted from members 102 and 104, through a routing assembly 112, to a nozzle assembly 114, which is typically housed in a receptacle 116 in a base plate 118. Nozzle 114 often comprises a number of baffles or similar structures intended to provide a gradual de-pressurization of carbonated water (e.g., by conducting the water through a series of increasingly larger apertures), presumably to reduce the level of gas loss and foaming (which itself causes additional gas loss) in the dispensed beverage. Usually, separate routing members 102 and 122 are utilized to keep water and syrup separate until depressurization is complete and both are delivered at receptacles 124 and 126 in nozzle assembly 114. Water and syrup flows might then be adjoined, just prior to dispensing into a cup below, within nozzle assembly 114 (not shown), or might be delivered from nozzle 114 into a cup in separate flows 128 and 130—allowing the turbulence of the liquid flow and gravity to mix the two liquids within the cup.

Conventional systems generally avoid mixing syrup and water prior to arrival in the dispensing nozzle. Mixing at any stage other than the nozzle is avoided, as it is generally considered to produce undesirable results. In fact, as described above, most conventional systems are designed such that mixing actually occurs in the cup. It is apparently believed that mixing prior to actual dispensing nozzle delivers an inferior carbonated product, and therefore most all soft drink dispensing systems (even those that may be used to dispense either carbonated or non-carbonated drinks) are designed this way. Conventional systems appear to assume that because the carbonated water is typically at a very high pressure, admixing the syrup within a constrained area (i.e., a valve or conduit) will cause foaming or some other similar reaction. Conventional systems appear to further assume that because mixing prior to the nozzle requires routing of the mixed product through some conduits or channels, liquid flow phenomenon (e.g., degassing in the case of soda) will result from that routing and disturb the quality of the product delivered (e.g., dispensing flat soda). Thus, with very few (if any) exceptions, conventional systems keep syrup and water separate until the actual point of dispensing.

Also of concern to beverage system designers is the ability to control and alter the mix ratio of the beverage constituents (e.g., syrup and carbonated water). In the past, conventional systems typically adjusted the valve members periodically, by means of a manual process, to alter the mix ratio of the ingredients of the beverage. Thus, subtle problems with mix may have gone undetected or uncorrected for some time. Recently, however, new sensor technologies have been developed which, when combined with non-manual mix control systems, provide closed loop mix control. Typically, however, sensing surfaces in these more robust mix control technologies must be in immediate contact with the liquid being dispensed, to accurately determine and adjust the mix of the beverage being dispensed. If they contact the beverage in low or high concentration portion of the stream, sensor readings will be inaccurate and product mix may be improperly adjusted.

This presents a problem when a conventional beverage dispensing system maintains separate liquid flows throughout, allowing mixing to occur in the cup. The advanced mix sensor/control systems cannot be utilized efficiently, if at all, because no point exists at which a sensor can be positioned in the stream of a completely mixed product. Even in conventional dispensing systems where mixing occurs in the dispensing nozzle, mixing may not be thorough—characterized by a variety of low and high concentration stream portions—and thus provide an inaccurate mix measurement. Additionally, incorporating desired sensor technology into conventional nozzle assemblies may be undesirable for a number of reasons (e.g., mechanical constraints, wear and tear problems, cost concerns).

SUMMARY OF THE INVENTION

Therefore, a versatile system for mixing beverages dispensed from a fountain or similar dispensing apparatus, where mixing is provided to work in conjunction with new beverage mix control technologies without significant beverage quality degradation, is now needed; providing cost-effective and efficient performance while overcoming the aforementioned limitations of conventional methods.

The present invention provides a mixing system having a versatile mixing channel, incorporated within a beverage dispenser assembly, that minimizes negative liquid flow phenomenon while providing sufficient surface area for mix control sensoring systems to contact a completely mixed product prior to dispensing.

More specifically, the present invention provides a fountain beverage mixing apparatus including a conduit having a deviated region adapted to mix a plurality of beverage constituents, a first aperture formed at a first end of the conduit and adapted to receive the plurality of beverage constituents from a plurality of supply sources, a second aperture formed at a second end of the conduit and adapted to dispense the mixed beverage constituents, and a sensor region disposed along the conduit proximal to the second aperture.

The present invention further provides a method of providing fountain beverage dispensing, by providing a plurality of beverage constituents, providing a beverage mixing apparatus having an inlet aperture, an outlet aperture, and a conduit interposed between the inlet and outlet apertures adapted to mix the plurality of beverage constituents, providing a dispensing nozzle engaged with the outlet aperture, conducting the beverage constituents into the inlet aperture, passing the beverage constituents through the conduit to render a mixed beverage, and dispensing the mixed beverage from the outlet aperture through the dispensing nozzle.

The present invention also provides a beverage dispensing system including a plurality of beverage supply sources adapted to supply a plurality of beverage constituents, a beverage mixing apparatus having a first aperture adapted to receive the plurality of beverage constituents, a second aperture adapted to dispense a mixture of the beverage constituents, and a conduit interposed between the first and second apertures and adapted to mix the plurality of beverage constituents, a dispensing nozzle engaged with the second aperture, and a sensor device disposed along the conduit, proximal to the second aperture, and adapted to adjust the supply of a beverage constituent.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and the use of the present invention is discussed in detail below, it should be appreciated that the present invention provides many applicable inventive concepts which can be embodied in a wide variety of specific contexts. The specific embodiments discussed herein are merely illustrative of specific ways to make and use the invention, do not delimit the scope of the invention.

The present invention provides versatile structures and methods for completely mixing beverage constituents within a dispenser assembly while minimizing negative liquid flow effects on the beverage, all while providing sufficient surface areas for mixture control sensoring systems to contact a completely mixed beverage prior to dispensing. The present invention recognizes that complete mixing of a beverage within a dispenser assembly, without substantial beverage degradation (e.g., gas loss) is feasible, and provides a versatile system therefor. The present invention comprehends, and is equally applicable with, the use of a variety of beverage dispensing systems and mixture control/sensor systems. The present invention provides thorough and efficient mixing for carbonated (e.g., soda) and non-carbonated (e.g., juice) beverages. For purposes of illustration, however, the present invention is hereafter described primarily in reference to a fountain-type dispenser for carbonated soft drinks.

Figure 1:
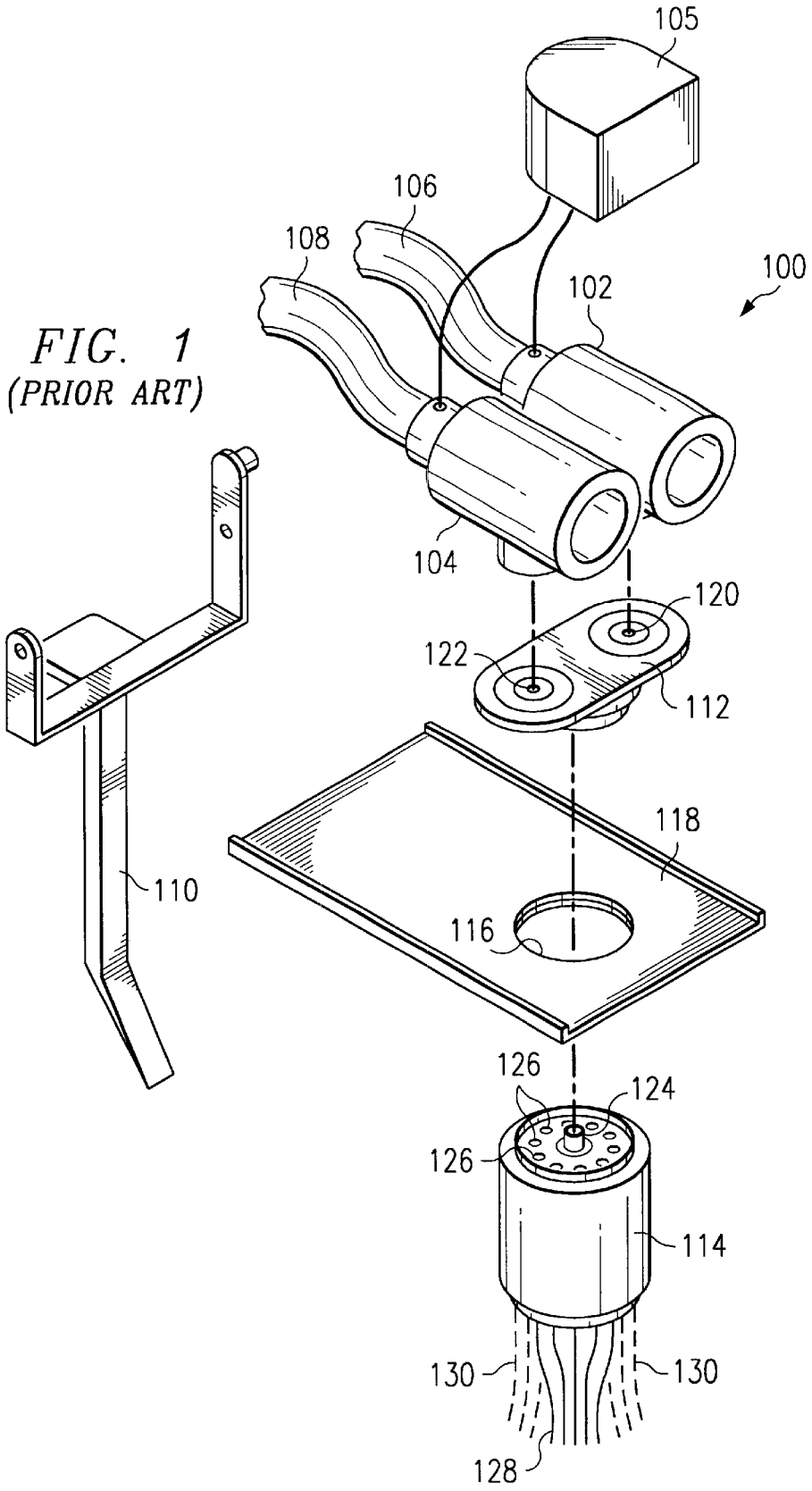
FIG. 1 (PRIOR ART)
FIG. 1 is a diagram of a PRIOR ART beverage dispensing system.
Figure 2:
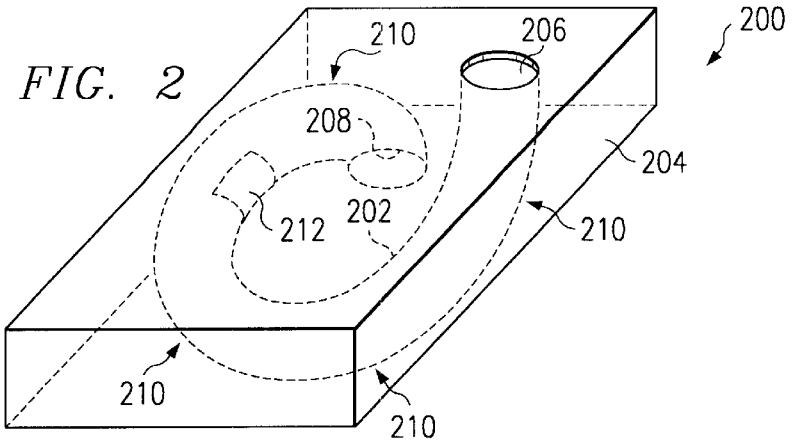
FIG. 2 is an illustrative diagram of one embodiment of a beverage mixing element according to the present invention.

Referring now to FIG. 2, one embodiment of a beverage mixing element 200 according to the present invention is illustrated. Apparatus 200 comprises a mixing conduit 202, formed of an appropriate material (e.g., plastic, metal) to process beverage constituents in accordance with the present invention. Conduit 202 may comprise a stand-alone structure (e.g., a semi-rigid metal flex hose), or may be formed or disposed within a housing 204 (e.g., a channel formed with injection molded plastic). Conduit 202 comprises an inlet aperture 206 and an outlet aperture 208, disposed at opposing ends of conduit 202. Conduit 202 is formed to have one or more deviated regions 210, which may be angled, curved, sloped, or any combination thereof, and provide selective routing of conduit 202 and beverage mixing in accordance with the present invention, as hereafter described. Conduit 202 further comprises one or more sensor regions 212, which are adapted to provide access by a desired mix sensor/control system to a mixed beverage flowing through conduit 202. Region 212 is generally located proximal to aperture 208, as access to a completely mixed beverage is preferred. The exact positioning of regions 212 in relation to aperture 208 may be varied depending, for example, on the overall length of conduit 202, the particular type of sensor used, or the desired configuration of conduit 202 within housing 204. A sensor device (not shown) may be inserted or otherwise coupled to conduit 202 at region 212, and secured to conduit 202 or within housing 204.

Operationally, aperture 206 is adapted to receive two or more beverage constituents (e.g., carbonated water and syrup) from two or more liquid supply sources (e.g., valves) for introduction into conduit 202. Aperture 206 may be formed to matably engage with the liquid supply valves (e.g. a snap lock assembly), or a secondary apparatus (e.g., a flexible gasket) may be used to interconnect the supply valves to aperture 206. The two or more beverage constituents are passed from aperture 206, through conduit 202, and delivered out from aperture 208. A dispensing nozzle (not shown) may be coupled to aperture 208, or alternatively, the aperture itself may be adapted to dispense the beverage directly into a cup.

Despite the teachings and apparent limitations of conventional systems, the present invention provides beverage mixing within a circuitous mixing channel without significant beverage quality degradation (i.e., degassing or loss of carbonation). The present invention recognizes that conventional systems typically only provide a complete mixing once the beverage is dispensed into a cup. Using conventional approaches, however, beverages are typically not significantly degraded by the mixing that occurs in the cup. Comprehending this, the present invention provides a gentle mixing dynamic within its apparatus that achieves results similar to the mixing dynamic that conventional systems effect within a cup. The selection, design, and configuration of the elements of the present invention are optimized to minimize negative fluid dynamics (e.g., gas loss) resulting from mixing in the mixing apparatus. In so doing, the present invention also provides the ability to effectively and efficiently utilize new beverage sensor/control technologies.

Conduit 202 is formed of a material having a smooth inner surface, to reduce fluidic turbulence that can result from rough surfaces and cause, for example, degassing. Conduit 202 is formed having a cross sectional area of sufficient size (i.e., diameter) to allow for unconstrained flow of the two or more beverage constituents, thereby preventing gas loss. The number, placement, and formation of deviated regions 210 are optimized to sufficiently mix the beverage constituents over the length of conduit 202 without resulting in too high of a flow velocity. Excessive flow velocity can increase degassing and other quality degrading effects. The angle and pitch of regions 210 may be formed, depending on particular design constraints and considerations, between 0 and 90 degrees. Particularly desirable results are achieved with region angles between 30 and 60 degrees, with 45 degrees generally providing the optimal balance of mixing and flow velocity. Depending upon space constraints and the constituents being mixed, any number of deviated regions 210 may be employed. As a result, conduit 202 may resemble a number of shapes, such as a flat spiral or a corkscrew. Furthermore, apertures 206 and 208 may be selectively formed or placed to enhance the shape of conduit 202 or to provide particular connectivity to dispensing valves or nozzles.

The mixing apparatus of the present invention may be utilized in the design of new beverage dispensing fountains—greatly simplifying architecture, reducing costs, and incorporating advanced sensor/control technologies—or it may be employed to adapt existing dispensing fountains to successfully utilize advanced sensor/control technologies.

Figure 3:
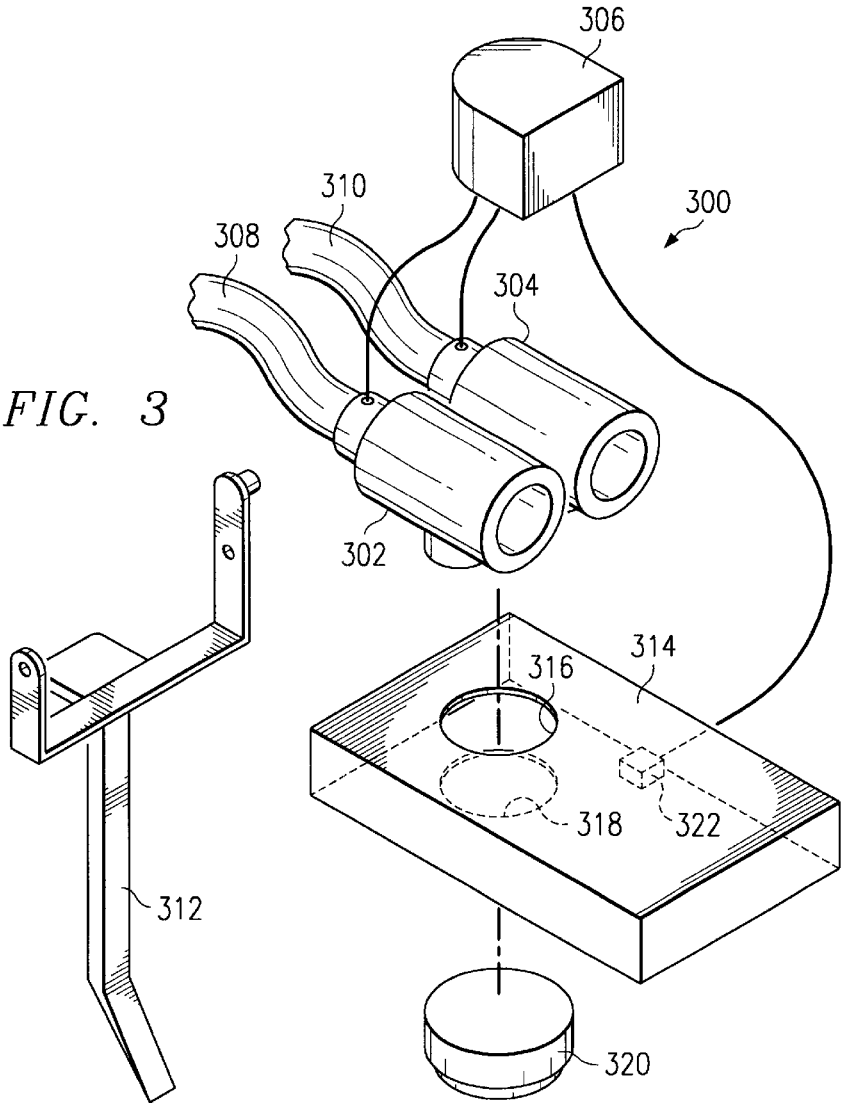
FIG. 3 is an illustrative embodiment of a beverage dispensing system according to the present invention.

FIG. 3 provides an illustrative, exploded-view diagram of a newly designed beverage dispenser system 300 according to the present invention. System 300 comprises a first liquid delivery valve 302 for syrup delivery, a second liquid delivery valve 304 for water delivery, a control assembly 306 communicatively coupled to valves 302 and 304, and conduits 308 and 310 coupled to valves 302 and 304, respectively, for providing syrup and water to the valve members from external sources (e.g., tanks or water lines). Although not shown, the present invention is also applicable in systems utilizing a single valve topology. Responsive to a consumer depressing the dispensing actuator 312, syrup and water are conducted from members 302 and 304, into a mixing apparatus 314 via aperture 316, and out of apparatus 314 through aperture 318, to a nozzle 320. Apparatus 314 is a mixing apparatus as described in reference to FIG. 2, and nozzle 320 may be coupled to aperture 318, or formed as a part thereof. As previously described in reference to FIG. 2, a mix control sensor device 322 may be disposed upon or within apparatus 314 and communicatively coupled to control assembly 306. Nozzle 320 is provided simply for directional control of the dispensed beverage stream, unlike most nozzle assemblies associated with conventional systems, which typically incorporate some baffling or mixing structures therein.

Figure 4:
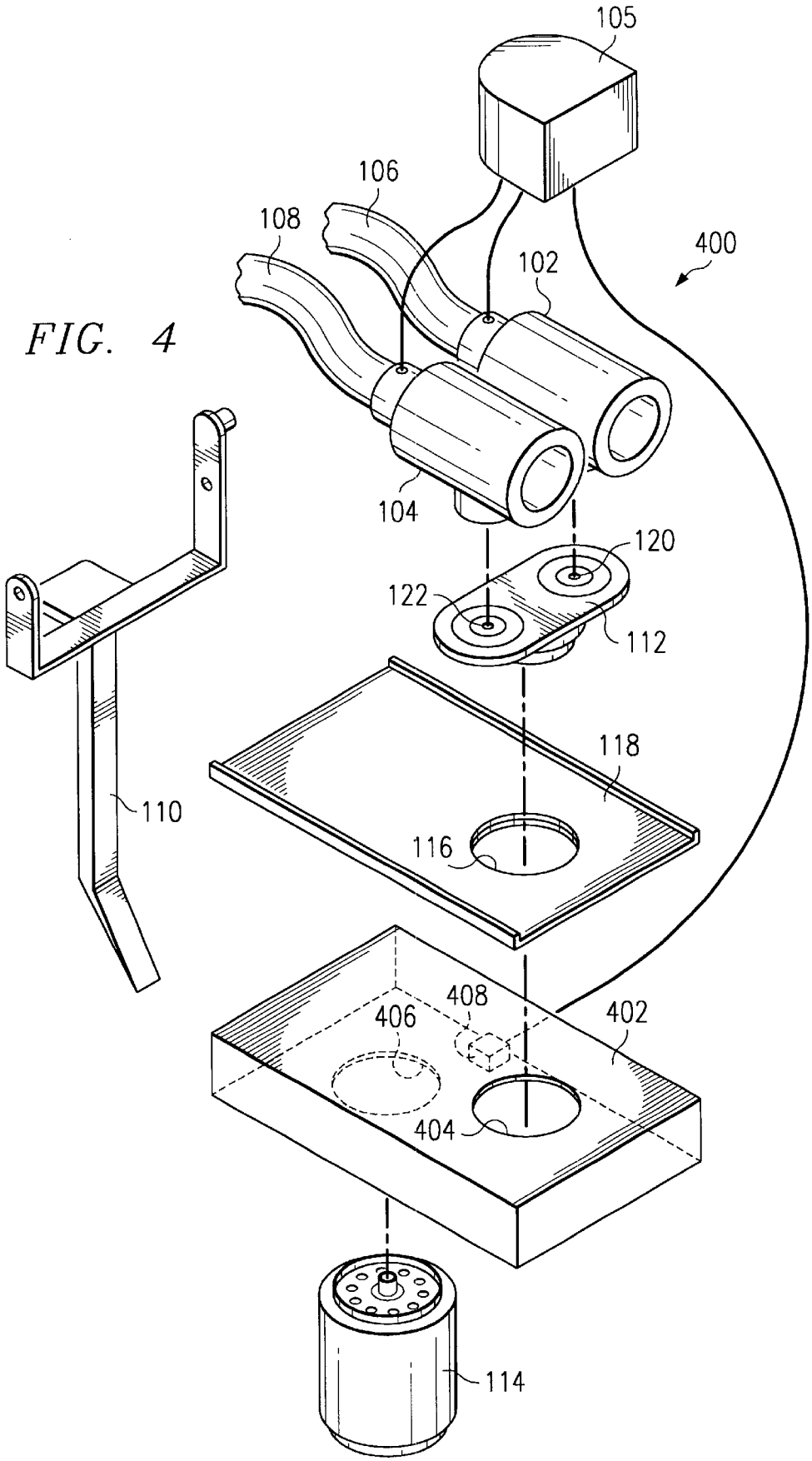
FIG. 4 is another illustrative embodiment of a beverage dispensing system according to the present invention.

Referring now to FIG. 4, an illustrative, exploded-view diagram of an existing conventional beverage dispenser system, modified by the present invention, 400 is depicted. System 400 represents one possible modification of an existing conventional dispenser system in accordance with the present invention. In system 400, a mixing apparatus 402 in accordance with the teachings of the present invention is selectively interposed between base plate 118 and nozzle assembly. Other configurations(e.g., having apparatus 402 interposed between base plate 118 and routing member 112) are also contemplated by the present invention. As depicted in FIG. 4, apparatus 402 has aperture 404 formed and adapted to align with and intercouple to receptacle 116 of base plate 118. This may be achieved using a screw-type or snap lock assembly, or using a flexible gasket. Similarly, apparatus 402 has aperture 406 formed and adapted to align with and intercouple to nozzle 114.

Apparatus 402 may be formed having appropriate dimensions to provide easy interconnection while maintaining required spacing (e.g., a minimum required space between the bottom of nozzle 114 and the top of a drain pan at the base of a fountain unit). System 400 provides the ability to effectively and efficiently integrate an advanced mix control sensor device 408 within the dispensing system. Although apparatus 402 renders some portions of system 400 redundant (e.g., baffle structures within nozzle 114), system 400 provides a cost effective means to retrofit existing dispenser systems until new dispensing systems, the architectures of which are simplified according to the present invention as previously described, are designed and manufactured.

While this invention has been described in reference to illustrative embodiments, this description is not intended to be construed in a limiting sense. Various modifications and combinations of the illustrative embodiments, as well as other embodiments of the invention, will be apparent to persons skilled in the art upon reference to the description. The teachings and concepts of the present invention may be applied to a variety of dispenser systems and sensor applications. The principles of the present invention are practicable in a number of technologies. It is therefore intended that the appended claims encompass any such modifications or embodiments.

What is claimed is:

1. A fountain beverage mixing apparatus comprising:

a conduit having a deviated region adapted to mix a plurality of beverage constituents;

a first aperture formed at a first end of the conduit and adapted to receive the plurality of beverage constituents from a plurality of supply sources;

a second aperture formed at a second end of the conduit and adapted to dispense the mixed beverage constituents; and a sensor region disposed along the conduit proximal to the second aperture.

2. The apparatus of claim 1 further comprising a housing containing the conduit.

3. The apparatus of claim 2 wherein the conduit is formed within the housing.

4. The apparatus of claim 2 wherein the conduit is disposed within the housing.

5. The apparatus of claim 1 wherein the conduit comprises a plurality of deviated regions.

6. The apparatus of claim 1 wherein the deviated regions comprise an angle between 30 and 60 degrees.

7. The apparatus of claim 1 wherein the deviated regions comprise a 45 degree angle.

8. The apparatus of claim 1 wherein the deviated regions are curved.

9. The apparatus of claim 1 wherein the deviated regions are sloped.

10. The apparatus of claim 1 further comprising a sensor device instantiated within the conduit in the sensor region.

11. A method of providing fountain beverage dispensing, comprising the steps of:

providing a plurality of beverage constituents;

providing a beverage mixing apparatus having an inlet aperture, an outlet aperture, and a conduit interposed between the inlet and outlet apertures operational to mix the plurality of beverage constituents;

providing a dispensing nozzle engaged with the outlet aperture;

conducting the beverage constituents into the inlet aperture;

passing the beverage constituents through the conduit to render a mixed beverage;

dispensing the mixed beverage from the outlet aperture through the dispensing nozzle; and providing a sensor device instantiated within the conduit and operational to control the conducting of the beverage constituents into the inlet aperture.

12. The method of claim 11 wherein the plurality of beverage constituents comprises carbonated water.

13. The method of claim 11 wherein the plurality of beverage constituents comprises non-carbonated water.

14. The method of claim 11 wherein the beverage mixing apparatus comprises a housing having the conduit and apertures formed therein.

15. The method of claim 11 wherein the beverage mixing apparatus comprises a housing having the conduit and apertures disposed within the housing.

16. The method of claim 11 wherein the step of providing a beverage mixing apparatus further comprises providing a conduit having a plurality of deviated regions.

17. The method of claim 15 wherein the deviated regions comprise an angle between 30 and 60 degrees.

18. The method of claim 15 wherein the deviated regions comprise a 45 degree angle.

19. A beverage dispensing system comprising:

a plurality of beverage supply sources adapted to supply a plurality of beverage constituents;

a beverage mixing apparatus having a first aperture adapted to receive the plurality of beverage constituents, a second aperture adapted to dispense a mixture of the beverage constituents, and a conduit interposed between the first and second apertures and adapted to mix the plurality of beverage constituents;

a dispensing nozzle engaged with the second aperture; and a sensor device disposed along the conduit, proximal to the second aperture, and operational to control the supply of a beverage constituent.

* * * * *